US007992527B2

(12) United States Patent
Merwin

(10) Patent No.: US 7,992,527 B2
(45) Date of Patent: Aug. 9, 2011

(54) WATER FEED CONTROLLER FOR A BOILER

(75) Inventor: Jeffrey C. Merwin, St. Charles, MO (US)

(73) Assignees: Potter Electric Signal Company, LLC, Hazelwood, MO (US); Taco, Inc., Cranston, RI (US)

( * ) Notice: Subject to any disclaimer, the term of this patent is extended or adjusted under 35 U.S.C. 154(b) by 1057 days.

(21) Appl. No.: 11/298,159

(22) Filed: Dec. 9, 2005

(65) Prior Publication Data

US 2006/0124078 A1 Jun. 15, 2006

Related U.S. Application Data

(60) Provisional application No. 60/634,696, filed on Dec. 9, 2004.

(51) Int. Cl.
*F22B 37/46* (2006.01)

(52) U.S. Cl. ..... 122/504; 122/451 R; 122/504.2; 137/392; 137/624.14

(58) Field of Classification Search ..... 122/504, 122/14.3, 451 R, 451.1, 456, 504.2, 505; 137/392, 558, 624.14
See application file for complete search history.

(56) References Cited

U.S. PATENT DOCUMENTS

| | | | | |
|---|---|---|---|---|
| 309,425 | A | 12/1884 | Wickersham | |
| 850,314 | A | 4/1907 | Phipps | |
| 1,558,997 | A | 10/1925 | Munzinger | |
| 1,947,725 | A | 2/1934 | Macarthur et al. | |
| 2,078,479 | A * | 4/1937 | Briggs | 122/448.1 |
| 2,385,161 | A * | 9/1945 | Pinkerton | 122/451 R |
| 2,752,461 | A | 6/1956 | Euler | |
| 2,934,287 | A | 4/1960 | Goetz | |
| 3,116,876 | A | 1/1964 | Palm | |
| 3,834,357 | A * | 9/1974 | Kaczmarek et al. | 122/504 |
| 4,619,224 | A * | 10/1986 | Takita et al. | 122/451 R |
| 4,662,390 | A * | 5/1987 | Hawkins | 137/392 |
| 5,224,445 | A * | 7/1993 | Gilbert, Sr. | 122/448.1 |
| 6,289,852 | B1 * | 9/2001 | Murgu et al. | 122/448.1 |
| 6,390,027 | B1 * | 5/2002 | Lyons et al. | 122/14.2 |
| 6,520,122 | B2 * | 2/2003 | Kemp et al. | 122/504.2 |
| 6,688,329 | B2 * | 2/2004 | Murray et al. | 137/392 |
| 7,093,611 | B2 * | 8/2006 | Murray et al. | 137/392 |
| 2002/0175822 | A1 | 11/2002 | Merwin | |
| 2004/0123659 | A1 | 7/2004 | Merwin | |
| 2004/0149335 | A1 | 8/2004 | Murray et al. | |

OTHER PUBLICATIONS

Excerpt from a Forum Sponsored by P&M Industries and Hosted by Dan Holohan (Apr. 2001).

(Continued)

*Primary Examiner* — Gregory A Wilson
(74) *Attorney, Agent, or Firm* — Lewis, Rice & Fingersh, L.C.

(57) ABSTRACT

A water feed controller which can provide for the addition of a preset fixed amount of water to be added after a low water condition is removed. This system provides for a preset fixed amount of water to be added to a boiler above the amount which triggers the low water condition. This generally inhibits excess cycling from the boiler operating at its minimum safe water level as well as inhibiting overfilling of the boiler. Further, there is discussed a water feed controller which can measure the amount of water added over a prior predetermined period (such as 30 days) which serves as a floating window of time so that a leak or other condition resulting in overly frequent filling can be detected quickly.

21 Claims, 5 Drawing Sheets

OTHER PUBLICATIONS

Holohan, Dan, "Holohan on Hydronics Stuff That Caught My Eye," Supply House Times (May 2002).
Wiring Diagram for Latching Relay Added to the VXT-24 Wired to a Hydrolevel Model 400.
Wiring Diagram for Latching Relay Added to the VXT-120 Wired toa McDonnell & Miller 67.
Wiring Diagram for Latching Relay Added to the VXT-120 Wired to a McDonnell & MIller PS 801.
Wiring Diagram for Latching Relay Added to the VXT-120 Wired to a Honeywell RW700.
McDonnell & Miller, Installation and Maintenance Instructions, MM321 Series WF2 Uni-Match Electric Water Feeder (Supplement Oct. 2001).
McDonnell & Miller, Installation Instructions, MM-308(A) Changing Flow Rate of Series WF-U Uni-Match Electric Water Feeder (1999).
McDonnell & Miller, Installation and Maintenance Instructions, MM-303(D) Series WF2 Uni-Match Electric Water Feeder (1998).
Hydrolevel Company, Installation Instructions, VXT-24.
Hydrolevel Company, Installation Instructions, VXT-120.
Fuel Oil News, "The Cure for Boiler Flooding," Jun. 1999.
Fuel Oil News, "Literature Showcases," Nov. 1999.
Fuel Oil News, "FON Literature Showcase," Spring 2000.
Fuel Oil News, "Oil Heat Training Directory," Aug. 1999.
Gifford, Henry, "When is That Old Boiler Shot?", HPAC Engineering, Oct. 2001.
McDonnell & Miller, Basic System Operation Guide, pp. 12-29.
Tekmar D269-Data Brochure.
Ashrae Journal, Feb. 1994, p. 46.

* cited by examiner

WATER FEED CONTROLLER FOR A BOILER

CROSS REFERENCE TO RELATED APPLICATION(S)

This application claims the benefit of U.S. Provisional Patent Application Ser. No. 60/634,696 filed Dec. 9, 2004, the entire disclosure of which is herein incorporated by reference.

(1) FIELD OF THE INVENTION

The present invention relates to a water feed controller or control system for use with a boiler. Particularly to water feed controllers which can provide for a preset fixed amount of water to a boiler after a low water condition is eliminated and which can provide for a floating window indicating when total water additions during a prior time period have exceeded specified thresholds.

(2) BACKGROUND OF THE INVENTION

Boilers have been used for generating steam in radiant heating systems in both residential and commercial applications for a number of years. The systems generally operate by heating boiler water to produce steam. The steam is then distributed through a piping system to distribute heat to the facility by having the distributed steam transfer heat to surrounding air. Once distributed, the resultant steam condenses and returns to the boiler to be heated again and redistributed.

Because of the way these boiler systems operate, it is necessary that there be sufficient water in the boiler system at all times. If the water level drops too low, the water in the boiler can flash to steam explosively, seriously injuring or killing people or damaging the boiler, facility or both. Steam boiler systems can also be damaged if they have too much water. In this case, liquid water can be forced from the boiler into the pipes along with the high-velocity steam which can lead to damage of piping, valves, or heating system components such as radiators. For these reasons, boiler systems are filled to their desired level during installation. They then include a Low Water Cutoff (LWCO) which will serve to turn off the heat source in the boiler if the water level drops below a safe level. The LWCO therefore serves as a protector against the system being operated with insufficient water and indicates that additional water needs to be added.

Historically, additional water was added manually to the boiler when the LWCO indicated a low water condition or boiler water levels were observed to be below normal operating levels. This was effective with sufficiently educated maintenance personnel in preventing overfilling. However, it was highly inconvenient and, if no one was around, could result in the boiler not providing heat until it was attended to. Therefore, recently, the water has been preferably added by mechanical or electronic water feed controllers.

Automatic water addition systems traditionally operated by adding water to the boiler until the LWCO no longer indicated a low water condition. At that time, the water level was presumed in a safe range and the heating source of the boiler could be enabled without risk of damage to the boiler. These systems, however, suffered from a series of problems.

The traditional role of the LWCO is to shut down boiler heat sources in the event that the water level is below a safe level, which is typically well below an optimum operating level. In addition to this function, the LWCO was configured to operate water feeding devices to replenish low water levels. The LWCO also serves to shut off the water feeding devices once the LWCO is satisfied by the water level. In particular, the LWCO was basically a switch that transferred power from the boiler's heating source to the automatic water feeder when a low water condition was detected and reversed the transfer once the low water condition was no longer detected. The system, therefore, automatically fed an amount of water into the boiler until the water level satisfied the LWCO. As it is a common practice for LWCO devices to be installed in such a manner that they operate slightly above the boiler's minimum safe water level, boiler systems that are automatically fed as noted above will be operating near at the boiler's minimum safe water level and generally no higher.

It is desirable in a boiler system to operate at a water level above the minimum safe water level for numerous reasons. First, operation above the minimum safe level provides an additional safety margin by adding hysteresis to the water level. Further, operating above the minimum safe level compensates for dynamic water levels due to boiling and surging of the boiler water. This prevents short-cycling of the boiler's burner due to the LWCO detecting these dynamic water levels caused by insufficient hysteresis in the water level. If the boiler is firing and it short-cycles due to these dynamic water levels, the burner controls are turned off in favor of the water feed. This cuts the heating cycle short and can cause flue gases to condense on internal boiler components. Over time, this reduces the life of heat exchangers and other critical components in the boiler and can lead to premature failures and costly repairs. When operating near the probe level of the LWCO, a slight leak, or even a fluctuation of the LWCO switch mechanism, can result in the burner being short-cycled unnecessarily.

Further, as a boiler system steams, water is converted to steam thereby lowering the water level of the boiler. This steam has a transit time as it passes through the heating system, condenses, and returns to the boiler as water. If the water level falls below the LWCO before the condensate returns to the boiler, the LWCO can detect a low water condition and initiate a water feed cycle. Depending on the delay in the condensate returning to the boiler, enough water may feed into the boiler that, when combined with the returned condensate, the boiler will be overfilled and flooded.

To deal with the problem of the water being prematurely fed due to the delay of returning condensate, delays have been added to some automatic water feeds so that the system's water level has a chance to stabilize before additional water is added. In particular, water is not added until a period of delay occurs after the LWCO was triggered. Therefore, the water was allowed to condense and return to the boiler so that the actual water level could be determined before water was added. This helped eliminate potential overfilling but can also result in increased short-cycling of the burner, when operating at the minimum water level.

To try and provide water above the minimum level in an automatic system, there are generally two possible methodologies for putting additional water into the boiler regardless of whether a delay after LWCO low water condition is used or not. In a simplistic case, water can be manually fed into the boiler system by a user pressing a manual feed button on the water feed controller essentially overriding the LWCO automatic feed to add more water. While this is effective, it requires a human user to operate the manual feed and to guess at how much water has been supplied (and needs to be supplied) to the boiler and provides little improvement over the original manual system.

In the alternative, the water feeder can be set to feed a fixed number of gallons into the boiler system each time the LWCO indicates a low water condition instead of simply filling until the LWCO no longer indicates a low water condition. When feeding a fixed number of gallons, it is required that the installer test the boiler system to identify precisely how much water a feed cycle must provide to prevent the feed cycle from accidentally overfilling the boiler. The water feeder must then be programmed to dispense that amount of water when the LWCO condition exists. The amount of water will be variable due to the water capacities of different models of boilers. An error in identifying the amount of water to be fed can lead to an insufficient amount of water, or too much water, being fed into the boiler. Insufficient water can lead to additional feed cycles being initiated by the water feeder, potentially overfilling and flooding the boiler. Similarly, if the amount of water that is programmed to be fed into the boiler is too large it is possible to overfill the boiler system. This flooding or overfilling of the boiler can prevent proper steam generation or result in water being propelled into the steam piping, damaging the piping systems.

In addition to the issues noted above, these systems still have further problems. If the boiler (or related components) was leaking, the continual water feeds would keep the water at a safe operating level, but would introduce a continual supply of fresh (oxygenated) water. This oxygenated water leads to increased corrosion in the boiler system and results in premature failure of the heating system.

All boilers will lose some water over time. The issue in determining whether water loss is significant enough to warrant replacement or repair requires examining how much additional water the system is requiring over a period of time (generally 30 days). As a leak will generally result in a steady loss, the only way to determine if a leak or other problem is sufficient to require action is to measure the amount of water added in a recent time period or to normalize loss to the calibration time period.

U.S. Pat. No. 6,688,329, the entire disclosure of which is herein incorporated by reference, is directed to one methodology for determining if excessive feed has been provided which could indicate that the boiler has a leak. The system described therein uses a display counter that indicates the number of gallons that the water feeder has dispensed since its totals were last reset. This display, therefore, provides water consumption information from which consumption over time can be computed.

This determination, however, requires extensive record keeping and manual computation. In particular, users must manually log the number of gallons shown on the display every 30 days so as to determine the 30 day usage rate. This is a complicated schedule to follow as it does not align with any calendar calculations and in most applications is impractical. In practice, users get the amount after some period, determine the length of the period, and normalize the amount of water used to a 30 day period. This number must then be manually compared against the manufacturer's expected water usage that must be found in water feeder or boiler documentation and can differ among boilers. This process is both manually cumbersome and fraught with the possibility of human error. Further, the process of normalization also introduces inaccuracies. In particular, as the period is not necessarily the same and water will be added as a batch when added, the normalization can serve to skew calculations such that the 30 day usage is too low or too high depending on whether fill actions occurred just outside, or just inside the measurement period.

Therefore, if the user does not record the water amounts from the display at reasonably consistent time intervals, the manual computation becomes more complicated and can become less accurate (as trends may not be as apparent or may end up averaged out over time). Further, the system relies on a person to correctly log usage data and to determine that excess usage is taking place. Therefore, the possibility of the introduction of human error is high and the indicators may not be reset or numbers may be recorded incorrectly. Further, if service personnel change, the new personnel may not know how or where the old data was recorded and may need to start essentially from zero.

There is still one additional problem with this methodology. Because the counter can be reset when the measurement is made, the measurements only occur at particular instances which are cyclical (generally with a minimum 30 days) and occur generally only once every time period. If the boiler developed a major leak soon after the water use for the prior 30-day period was recorded, the leak may cause significant damage before the next check (around 30 days later) would determine that a leak had even occurred. Further, with regards to smaller leaks, it could actually take three or more different measurement periods before a leak condition would become apparent to a user. This is because the fill activities generally will occur sporadically and an increase in the fill in the normalized period may not be recognized as a leak, but may instead simply be thought to be due to having an additional and expected fill event fall in the time between measurements.

In general, the existing practice of cyclical observation prohibits relatively real-time notification that excessive water use is taking place and can allow for error situations to be missed (or incorrectly detected) due to natural fluctuations within the periods of measurement.

SUMMARY OF THE INVENTION

Because of these and other problems in the art, described herein are systems and methods related to an automatic water feed controller for a boiler which provides for improved filling of the boiler to a level in the generally preferred operating range and above the minimum safe operating level and which also provides for automatic, near real time, detection of a potential leak condition.

Described herein, among other things is a water feed controller for a boiler, the controller comprising: electronics for monitoring the signal from a low water cut-off (LWCO); electronics for opening and closing a water path; and a processor; wherein when said electronics for monitoring detect a low water signal from said LWCO, said processor initiates opening of said water path to allow water to flow into said boiler; wherein said water path remains open until said LWCO ceases signaling a low water condition; and wherein said processor allows said water path to remain open after said LWCO ceases signaling said low water condition, so a preset fixed amount of water is added into said boiler after said LWCO ceases signaling said low water condition.

In an embodiment of the controller, the preset fixed amount is set when said water feed controller is installed or the preset fixed amount of water is determined by the setting of a Hold After Water ok (HAW) switch.

In an embodiment of the controller, the controller also includes: a flood lockout system, said flood lockout system closing said water path and not allowing said water path to reopen if the combined amount of water added to said boiler both prior to said LWCO ceasing signaling a low water condition and added after the LWCO ceased signaling a low water condition, is over a predetermined maximum amount of water.

The flood lockout system may also indicate to a human user that said combined amount of water is over said predetermined maximum amount of water and the indication may be sent to a remote location.

There is also described herein a water feed controller for a boiler, the controller comprising: means for detecting a low water condition in said boiler; and means for opening and closing a water path into said boiler; wherein when said means for detecting detects a low water condition, said means for opening and closing opens said water path to allow water to flow into said boiler; wherein said means for opening and closing maintains said open water path until said means for detecting no longer detects said low water condition; and wherein said means for opening and closing does not close said open water path, until a preset fixed amount of water is added into said boiler after said means for detecting no longer detects said low water condition.

In an embodiment of the controller there is included a flood lockout means for closing said water path and not allowing said water path to reopen if the total amount of water added while said water path was open is over a predetermined maximum amount of water.

In an embodiment, of the controller there is included an alarm means for notifying a human user that said total amount of water added is over said predetermined maximum amount of water. The alarm means may notify a human user located remotely of said water feed controller.

There is also described herein, a method for feeding water to a boiler, the method comprising the steps of: detecting a low water condition in said boiler; opening a water path to allow water to flow into said boiler; waiting for said low water condition to cease; allowing said water path to remain open until a preset fixed additional amount of water has been added to said boiler after said low water condition ceased; and closing said water path.

In an embodiment of the method there may also be included the steps of: repeating the steps of the method every time a low water condition is detected; and determining if the total amount of water added during the last instance of said method is over a predetermined maximum amount of water, and if said total amount of water added during said last instance is above said predetermined maximum amount of water, inhibiting said step of repeating. If said total amount of water is above a predetermined maximum amount, the step of closing may be immediately performed and an alarm condition may be triggered if said amount of water added during said last instance is above said predetermined maximum amount of water.

An embodiment of the method may also include the steps of: determining if the total amount of water added during all instances of said method occurring within a predetermined period of time is over a predetermined maximum amount of water; and if said total amount of water added during all instances of said method occurring within said predetermined period of time is above a predetermined maximum amount of water, not performing said step of repeating. An alarm condition may also be triggered if said total amount of water added during all instances of said method occurring within said predetermined period of time is above said predetermined maximum amount.

There is also described herein, a system for controlling water feed to a boiler, the system comprising: electronics for monitoring the signal from a low water cut-off (LWCO); electronics for opening and closing a water path into said boiler; and a processor having a clock source; wherein when said electronics for monitoring detect a low water signal from said LWCO, said processor initiates opening of said water path to allow water to flow into said boiler; wherein which said processor determines when said boiler has sufficient water to close said water path to said boiler, said electronics close said water path; wherein said processor adds the amount of water added between the instance of opening and closing the water path to a value representative of the water added for a sub-period of time determined by said clock source; wherein at the end of said sub-period of time, said processor writes said value for said sub-period to a memory; and wherein said processor computes the total amount of water added in a period by adding the values for the immediately prior sub-periods forming that period; and wherein if said amount is over a preset limit, triggers an alarm condition.

In an embodiment the period may comprise 30 days and said sub-period comprise one day. Further, when said alarm condition is triggered, said system may not allow additional water to be added to said boiler during the current sub-period.

DETAILED DESCRIPTION OF THE PREFERRED EMBODIMENTS

Figure 1:
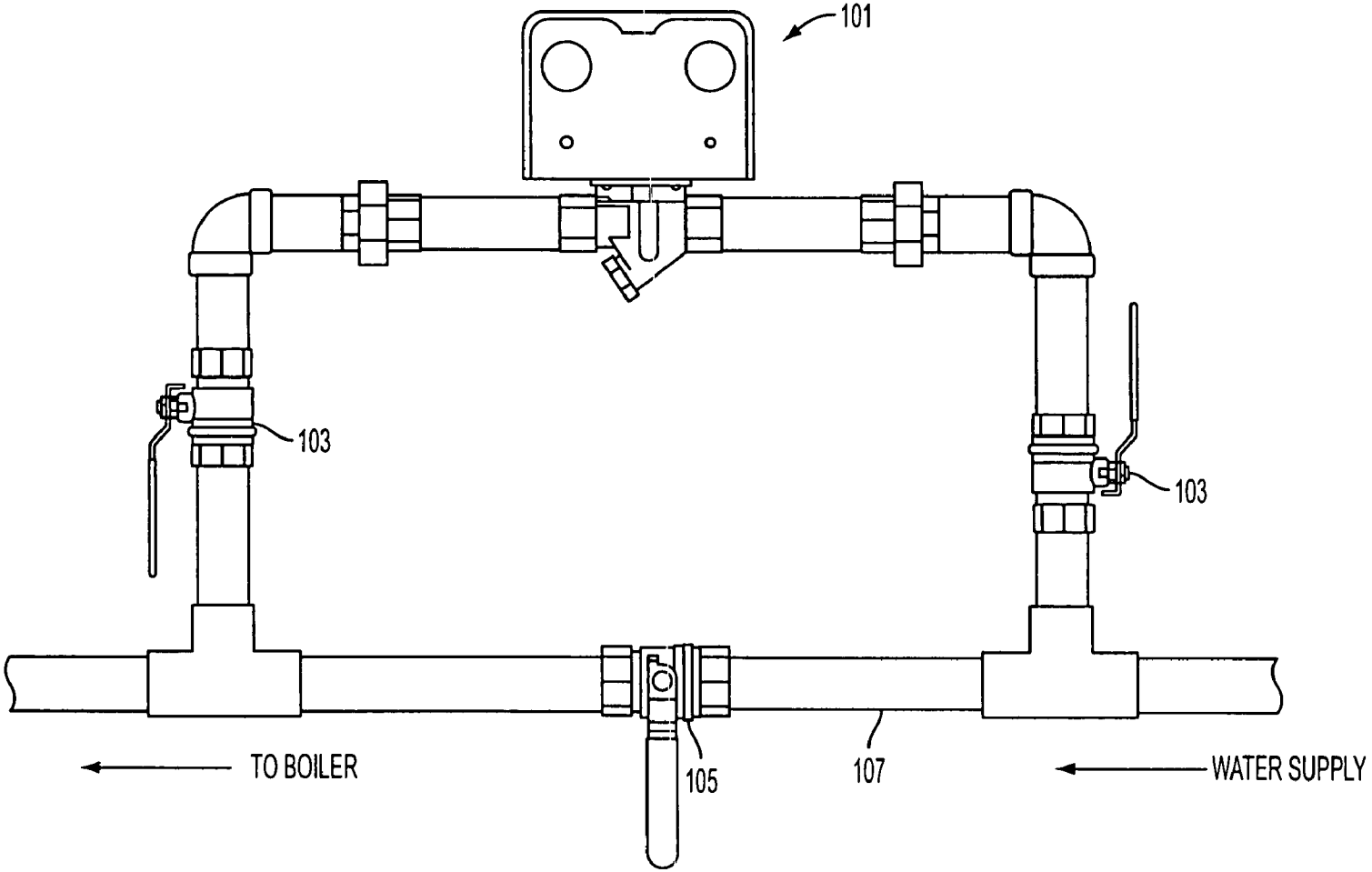
FIG. 1 shows an overview of an embodiment of a water feed controller installed in a boiler water supply.

FIG. 1 provides for an embodiment of a water feed controller (101) in a piping setup to feed a boiler. The water feed controller (101) will generally be installed on a pipe bypass including valves (103) to allow for the water feed controller (101) to be isolated from the main water line (107), if necessary. This isolation provides for the ability to perform maintenance on the water feed controller (101) or to take the water feed controller (101) out of the water path in the event of malfunction. There will generally be a manual by-pass valve (105) in the main water line (107) to allow for filling the boiler upon initial installation or refilling when the water feed controller (101) has been isolated or is not in service.

Figure 2:
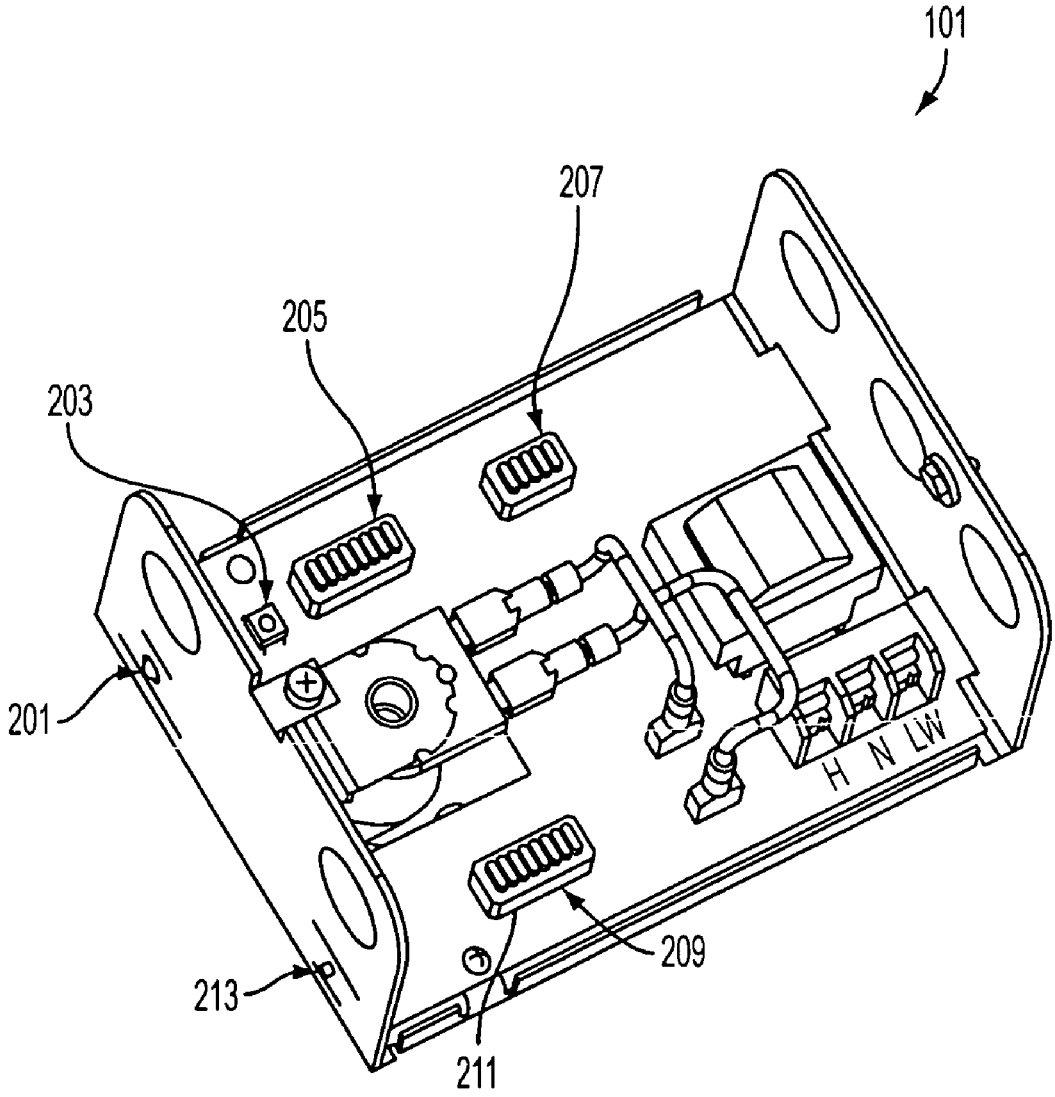
FIG. 2 shows a general internal view of the components of an embodiment of a water feed controller.
Figure 3:
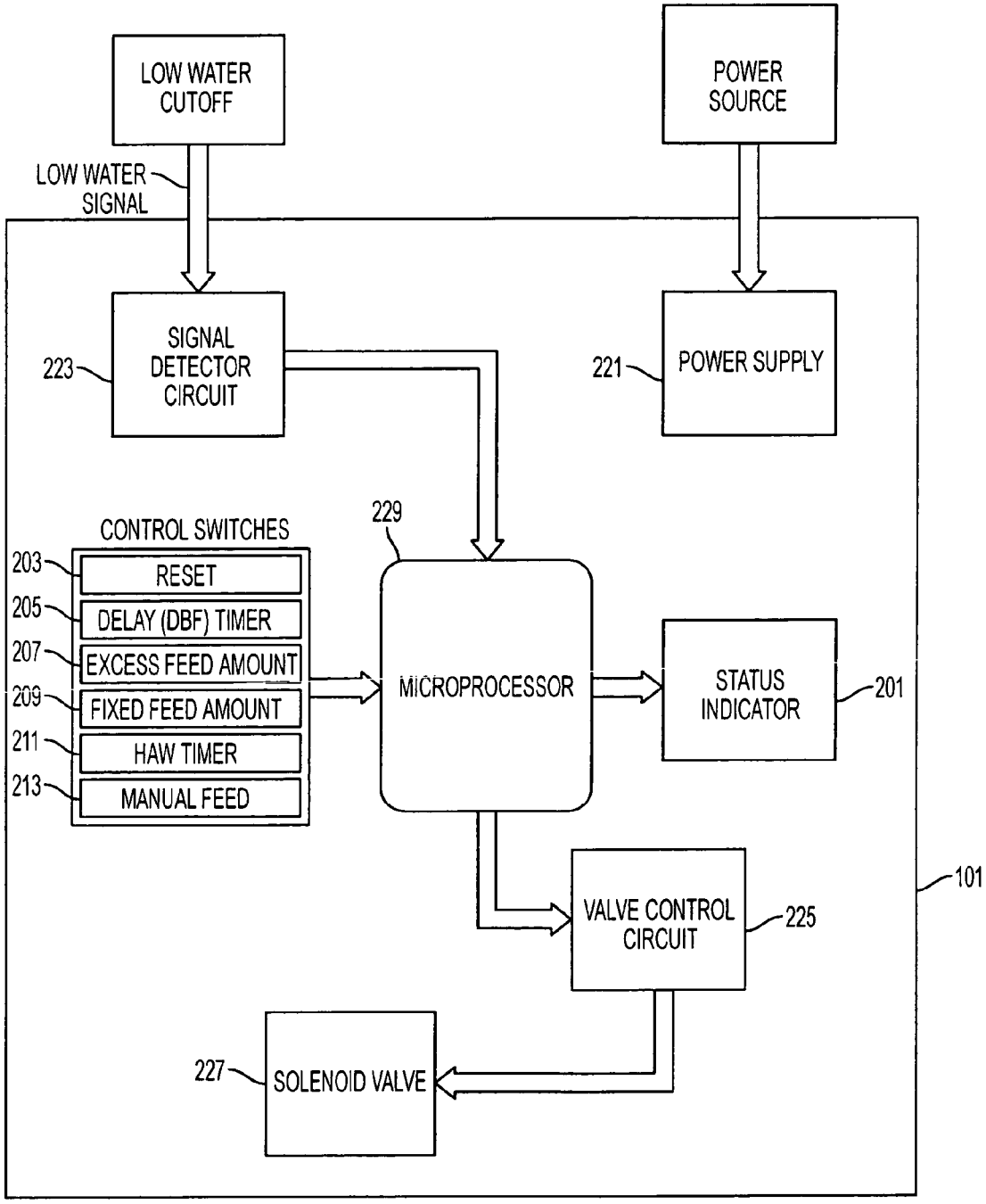
FIG. 3 provides a block diagram of elements of an embodiment of a water feed controller.

FIG. 2 provides for an overview of the internal components of an embodiment of a water feed controller (101). Another embodiment is shown in the block diagram of FIG. 3. In particular, FIGS. 2 and 3 show a water feed controller (101) including a feed status indicator (201), an excess feed reset (203), a switch for setting the low water cut-off (LWCO) delay timer cycle (205), a switch for setting excess feed triggers (207) and a switch for setting feed (209) and Hold After Water ok (HAW) (211) amounts. The depicted embodiment also includes a manual fill button (213) which allows the user to add water to the boiler regardless of any determination by the LWCO that additional water is necessary or to reset a flood lockout condition. The embodiment will generally also comprise a power supply (221), electronics for monitoring the signal from an LWCO (223), electronics for controlling a solenoid valve (225), and a solenoid valve (227) for opening and closing the water path for the feeding of additional water as shown in FIG. 3.

Figure 4:
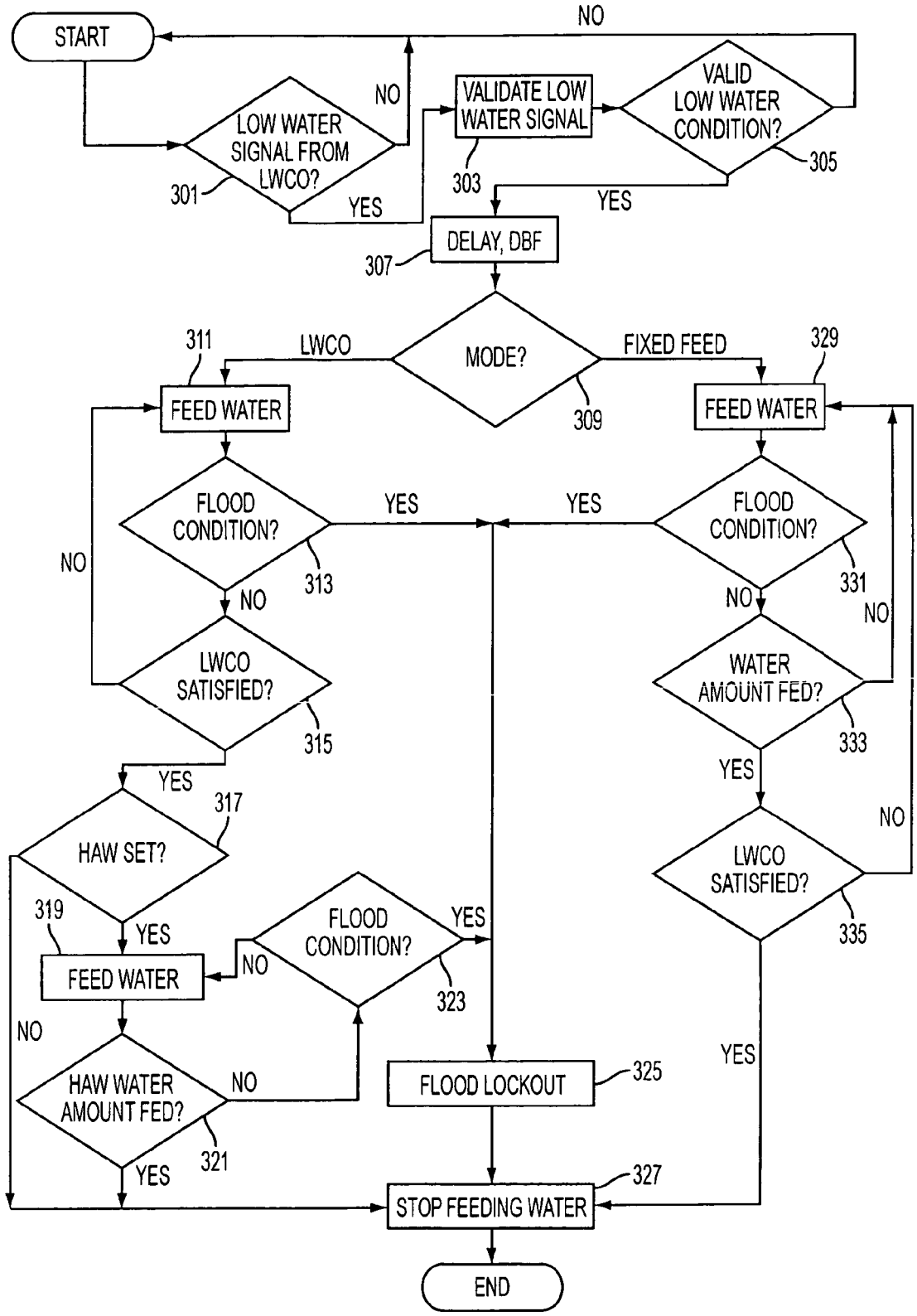
FIG. 4 provides a flowchart of the steps for performing a fill operation.

An embodiment of the operation of the water feed controller (101) as shown in FIGS. 2 and 3 is shown in FIG. 4. The water feed controller shown in FIGS. 2 and 3 provides for two different feed modes depending on the manner which the user would like to add water and have the system operate as shown by the parallel arms on the flowchart of FIG. 4. The different feed levels are selected by the user during installation and may later be changed. In FIG. 4 the first step is the indication that the LWCO is at a low water condition (301) indicating that additional water needs to be added to the boiler. The system will validate the low water signal as an accurate indicator of low water in step (303). If the low water signal is valid (305), the system then proceeds with any programmed delay (307). Otherwise, sufficient water is still present and a feed is not necessary. When a period of delay is used, this period will generally be set by the water feeder's delay timer (205) prior to the low-water condition occurring. Once any delay (307) expires, the system must determine which mode it is in, LWCO mode or fixed fill mode, in step (309) if the LWCO is still indicating a low water condition.

In the fixed fill mode, water is added in step (329). As water is added, the system determines if a flood condition criteria has been met in step (331). In this determination, the system will determine if too much water has been added and there are concerns about flooding. If a flood condition may exist in step (331) a flood lockout is initiated at step (325), the water feed stops in step (327) and the process ends. If there is no flood condition, the system determines in step (333) if the fixed feed amount has been added yet. If not, the system continues to feed water in step (329). Once the fixed amount of water has been added, it is determined if the LWCO is still reading a low water condition in step (335). Once the LWCO is no longer reading a low water condition, the system is deemed filled and the water feed is stopped in step (327). If, however, the LWCO still reads that there is a low water condition in step (335), another fixed feed cycle is initiated. The flood lockout condition of step (325) is principally designed so that if the system believes too much water has been added, there may be an error which is either a major leak or the LWCO has malfunctioned and is no longer correctly reading the water level. As the malfunction may have led to unnecessary water being added to the boiler, the system will generally indicate a flood lockout on feed status indicator (201) in step (325) and may prohibit the boiler from reactivating or from receiving more water until it has been checked by maintenance personnel. In this way, the system can handle a malfunction or a major leak and notify personnel of the problem very quickly instead of running the system in what is a potentially damaging configuration. The amount of the fixed feed may be set by the user using feed switch (209).

In the LWCO mode, water is fed in step (311) again checking for a flood condition in step (313) until the LWCO no longer indicates a low water condition in step (315). At this time, the water level is above the minimum operating level and the LWCO switches off. The system next determines if a HAW setting has been enabled. If not, the cycle is complete and the water feed is stopped in step (327). This mode therefore generally provides for automatic fill in the manner of a standard LWCO automatic fill switch and may be preferable in some situations although it generally does not allow for filing of water to an optimum level.

If a HAW setting has been enabled in step (317), the system will feed water in step (319) until the HAW amount of water has been added in step (321). The system will also check to see if a predetermined "flood level" of water has been fed yet in step (323). If the flood level has not been met, the water feed continues. If the level has been met, the system will generally determine that either the LWCO is malfunctioning, or the system has developed a major leak and will shut off the water supply and enter a flood lockout mode in step (325) indicating the lockout on feed status indicator (201). Once the system has added the predetermined amount of water in step (321) to meet the HAW setting, which is generally predetermined by the selected position of HAW switch (211), the system will automatically stop feeding water in step (327) as the feed is complete.

The additional feed time after the LWCO ceases indicating that there is a low water condition using the HAW setting allows the boiler system to fill higher than the boiler's minimum safe water level as defined by the LWCO turning off. This permits the water level to rise above the level of the LWCO probe or float mechanism and provide additional water into the system, thus providing hysteresis for the water level and to reach the boiler manufacturer's recommended water level. This prevents intermittent low water conditions and resultant short cycling of the boiler during calls for heat. One advantage of the HAW mode over other modes is that in the HAW mode, the water level at boiler reactivation is generally fairly well known and a relatively known amount above the minimum level, in the other modes, the level is usually more variable and/or closer to the minimum. Specifically, the HAW setting represents a preset fixed amount of water, preferably defined by a time setting, which is added after the low water condition is no longer detected. In effect, it's a fixed amount above the minimum operational level.

As discussed above in conjunction with FIGS. 2 and 3, one device which is included in an embodiment is the feed status indicator (201). In the depicted embodiment, the feed status indicator (201) is an LED capable of different modes of operation (such as emitting different colors, blinking or lighting steadily). In alternative embodiments other indicators may be used including, but not limited to, visual displays, audio communications, communications to other equipment, or a combination of the above. The feed status indicator (201) will generally indicate that the flood lockout condition has occurred and may also indicate other statuses such that a feed is currently occurring or that the water feed controller is operating normally. As discussed above, the flood lockout condition will generally occur when the system determines that more water than should be necessary to remove a low water condition has already been added, and yet the low water condition persists or additional water is being called for. This situation will generally be indicative of a failure of the LWCO such that it is no longer indicating the correct level of water, incorrect water feeding system setup, or a large leak. Any of these failures require quick correction and notification to prevent damage to both the boiler and surrounding area.

Even without a large leak or other immediate concern, the boiler can still have problems from a small leak that is persistent. When a steam boiler system is regularly leaking steam or water, an automatic water feeder will fill the boiler water to compensate for the leaks. While this keeps the boiler system functioning at a safe water level, the continual addition of fresh water into the boiler can lead to increased corrosion due to the fresh supply of oxygen contained in the make-up water. This corrosion shortens the life of the boiler system and eventually leads to premature failure and repair or replacement of the boiler system, typically at great cost to the business or home owner.

The feed status indicator (201) also provides, in the depicted embodiment, a visible indication that the boiler system is consuming excessive amounts of water over a specified time period in addition to the particular fill related situations discussed above which are more acute repair issues. That is, the system not only identifies excessive water feeding during a particular feed cycle which can cause flooding issues, but also recognizes excess feed from multiple cycles over time which is a more persistent problem.

Figure 5:
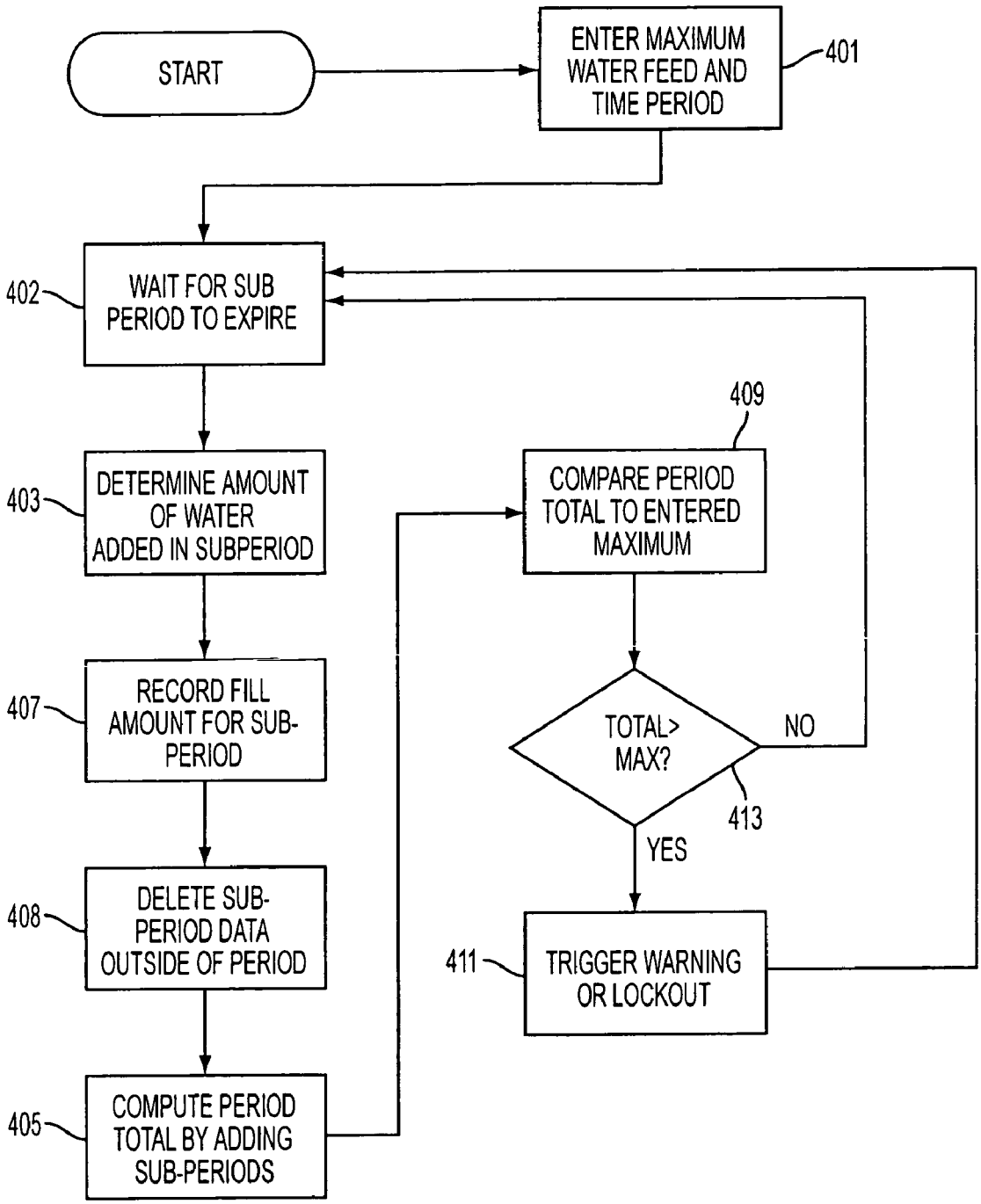
FIG. 5 provides a flowchart for the steps of determining an excess feed indication.

In the depicted embodiment, the operation of the excess feed indicator preferably will provide for automatic determination of when too much water has been fed as shown in the steps of the flowchart of the embodiment of FIG. 5. Excess feed will generally be determined to exist when the feed exceeds the typical industry guidelines for water usage over the most recent time period corresponding to the industry guideline period. To accomplish this measurement, the system will generally comprise a microprocessor (229) or similar device capable of making calculations relative to a real-time clock source. The user will first indicate to the processor (229) the period of time over which the measurement is to occur (for example, 30 days) and the maximum amount of water which should be fed to the boiler in that period of time in step (401). In particular, a user may set the excess feed control switches (207). These values will generally be determined based on industry guidelines. The processor (229) or other device will then monitor the amount of water added to the boiler over a time period of the specified length.

In particular, the system will generally wait until either a fill event occurs or a sub-period (for instance, an hour or day) in the period expires in step (402). The processor (229) will then determine the amount of water added in the sub-period in step (403) and record that value as the value for the sub-period in step (407). Generally, as the update occurs for this sub-period, the processor (229) will delete or overwrite a prior entry for a similar sub-period which is now outside the period in step (408). The processor (229) will next take the value for the new sub-period and add it to a number of prior recorded values by the processor (229) in step (405) to make up the predetermined period that was entered in step (401). For instance, if the sub-period is one day and the period is 30 days, the processor (229) will take the current value and add to it the value for the prior 29 days which have been stored in memory associated with the processor (229). After the addition in step (405), the processor (229) in step (409) will compare the total to the value set by the user in step (401) for the total feed in the period. If the value is greater than the total in step (413), the processor (229) will trigger an indication of such status in step (411) indicating the condition with feed status indicator (201). This indication may also lock out additional water from being provided. If the value is less, the system will simply maintain monitoring and advance to the next sub-period.

It should be recognized that some sub-periods may have no fill while others may have a relatively large amount due to the fixed size of the fill in some operations. As the period is measured by the total number of sub-periods forming the period of interest closest to the current time, this rolling window will flatten out the bumps from these fill events and better show water use trends over time. Further, because of the use of a rolling window, the system could, if desired, indicate excess feed for a short period if an unexpected fill event occurs, but could later automatically reset (remove the condition) once this period has passed because the monitoring is continuous. This provides that if a situation occurs which might be problematic, the system indicates excess feed, but if it is only a spike in water consumption, (due, for example, to boiler servicing), it is relatively quickly reset automatically and the spike in water consumption is averaged out by regular operation. In this way, the system provides for valuable monitoring by interrelating multiple, different types of fills. For instance, if boiler service is performed and a relatively large fill event occurs, the monitoring system may indicate an overage for 30 days. This may lockout additional water from being added to the system during those thirty days. If the LWCO indicates a low water condition during these thirty days, the dual condition can trigger a more immediate warning. This can be beneficial because the boiler, after servicing, should not need additional water this quickly and a potentially inaccurate repair can be quickly detected.

This arrangement provides for much more effective monitoring of the amount of water being fed into the boiler over the period of time based upon industry guidelines. The system monitors the total amount of water added in a particular period of time in essentially a rolling window of that time length which ends close to the current time. If the period is 30 days, the processor will look at the most recent 30 days to determine if the system has exceeded the predetermined total for the period of time and automatically moves the window as time progresses. In this way, any period of time can be easily used as there is no dependency on human measurement and the value is never normalized, but is based on actual use for the most recent period (the period ending at any given time). Further, if it is desired to alter the time period, calculations can be made relatively automatically and easily adjusted to calculate for 45-day, 60-day, or any other length of windows that may be desired.

It should be apparent that there is no need to compute usage by hand or normalize usage for a particular period. Further, if excessive water amounts were to be fed, that condition will be detected as soon as the excessive amount is fed instead of having to wait for an entire additional period for a user to manually note water usage as in other systems. Further, the system provides for a regular computation regardless of the length of days in a month, without having to abide by a complicated schedule of checking, and can automatically reset if an excess feed condition possibly exists, but is then shown to not be the case.

Alternatively, if a fill event occurs indicating a 30-day overage of water due to a slightly faster fill schedule, the monitoring can indicate the problem, but will quickly reset as a leak concern if not indicated as a major concern yet. In effect, as a leak grows more persistent, the monitoring will be more and more likely to be indicating a concern at any given time, making leaks requiring repair much easier to detect when the output of the monitor is monitored only at limited intervals. Further, a persistent leak will actually be more persistently indicated.

This eliminates many of the issues normally associated with manually recording water usage and computing water usage. Inclusion of the flow status indicator (201) also allows the user or service personnel to set a limit for the number of gallons that the boiler system should use over a set period of time and be notified when there is a problem. Once the system is installed and set up, it automatically signals the user when excessive water use has occurred. This eliminates manual logging, computing, and comparing the boiler water usage to documented tables to determine if the boiler system has a potential problem. Further, because the system preferably includes a rolling time period, the system is effectively near real time in its calculation. For instance, if device were to spring a leak on the 31 st day after the installation using a 30-day period, this leak would probably be detected long before the 60th day when it would be detected using the best manual calculation processes. The shutoff of the system when there is concern can also prevent excess damage from overfilling or similar problems in the event of danger, while the automatic reset can prevent spikes in water consumption from requiring maintenance if the problem is not persistent.

The embodiment depicted in FIG. 2 uses a visible indicator such as an LED or other light to signal excessive water use or need for system maintenance. This provides for a simple and effective methodology to indicate a flood lockout situation or excessive water use situation that requires attention. The water feed controller (101) may, however, be in a basement and may not be regularly examined by service personnel. Therefore, in an alternative embodiment, signaling of a flood lockout condition occurs via a relay or other methodology which allows for the condition to automatically engage other equipment or to provide for an alarm or indicator to a remote location. This transmission may occur in any medium and may send any information including, but not limited to, using protocols such as RS-485, Firewire (IEEE standard 1394), X10, Ethernet, Arcnet, Bacnet, or Hypertext Transfer. This could provide remote monitoring or control of the boiler system. Further, the processor (229) may provide additional information instead of just indicating that a flood lockout or excessive feed condition exists. For instance, the processor (229) may indicate what fill event triggered the flood lockout or excess feed condition and may also provide indications of current readings of the processor, including the usage in the period and all the recognized sub-periods, current or prior readings of the LWCO, the time since the flood lockout occurred, and/or other information that could be obtained by the processor (229). This additional information can be reviewed by service personnel to detect the potential problem or to quickly reset the system if there is no actual problem.

The flood lockout condition will generally be able to be overridden by maintenance personnel once they have determined that the condition is acceptable or have fixed the underlying issue. This reset will generally utilize the flood lockout reset (203) on the water feed controller (101). Further, this override may occur remotely, for instance, if maintenance personnel cannot immediately come down to inspect the boiler, but it is important that the boiler continue to run, the maintenance personnel may override the flood lockout condition remotely via any of the previously noted communication protocols.

In the embodiments of FIGS. 2 and 3, one additional function is also included which is a manual fill button (213). The manual fill button (213) allows a user to manually instruct the water feed controller (201) to add additional water even if the LWCO is not indicating a low water condition and if no other fill condition has been implemented. The manual feed button (213) is essentially a second way to fill the boiler in addition to opening manual by-pass valve (105). However, using manual feed button (213) instead of by-pass valve (105) provides the benefit of allowing maintenance personnel to add extra water for whatever reason they think is appropriate, while still making sure that such an addition is logged as fill during the period for the processor's (229) excess fill calculations. In this way, if the system is operating in LWCO mode, maintenance personnel can raise the fill level above the minimum, and still be notified if their action results in an indication of excess water usage. In this way, a leak is more likely to be detected regardless of the mode in which the system is operating.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A water feed controller for a boiler, the controller comprising:

electronics for monitoring the signal from a low water cut-off (LWCO);

electronics for opening and closing a water path; and a processor;

wherein when said electronics for monitoring detect a low water signal from said LWCO, said processor initiates opening of said water path to allow water to flow into said boiler;

wherein said water path remains open until said water reaches said LWCO and said LWCO ceases signaling a low water condition; and wherein said processor allows said water path to remain open after said LWCO ceases signaling said low water condition, so a preset fixed amount of water is added into said boiler after said LWCO ceases signaling said low water condition.

2. The water feed controller of claim 1 wherein said preset fixed amount is set when said water feed controller is installed.

3. The water feed controller of claim 1 further comprising: a flood lockout system, said flood lockout system closing said water path and not allowing said water path to reopen if the combined amount of water added to said boiler both prior to said LWCO ceasing signaling a low water condition and added after the LWCO ceased signaling a low water condition, is over a predetermined maximum amount of water.

4. The water feed controller of claim 3 wherein said flood lockout system also indicates to a human user that said combined amount of water is over said predetermined maximum amount of water.

5. The water feed controller of claim 4 wherein said indication is sent to a remote location.

6. The water feed controller of claim 1 wherein said preset fixed amount of water is determined by the setting of a Hold After Water ok (HAW) switch.

7. A water feed controller for a boiler, the controller comprising:

means for detecting a low water condition in said boiler; and means for opening and closing a water path into said boiler;

wherein when said means for detecting detects a low water condition, said means for opening and closing opens said water path to allow water to flow into said boiler;

wherein said means for opening and closing maintains said open water path until said means for detecting no longer detects said low water condition; and wherein said means for opening and closing does not close said open water path, until a preset fixed amount of water is added into said boiler after said means for detecting no longer detects said low water condition.

8. The water feed controller of claim 7 further comprising: flood lockout means for closing said water path and not allowing said water path to reopen if the total amount of water added while said water path was open is over a predetermined maximum amount of water.

9. The water feed controller of claim 8 further comprising alarm means for notifying a human user that said total amount of water added is over said predetermined maximum amount of water.

10. The water feed controller of claim 9 wherein said alarm means notifies a human user located remotely of said water feed controller.

11. A method for feeding water to a boiler, the method comprising the steps of:

detecting a low water condition in said boiler;

opening a water path to allow water to flow into said boiler;

waiting for said low water condition to cease;

allowing said water path to remain open until a preset fixed additional amount of water has been added to said boiler after said low water condition ceased; and closing said water path.

12. The method of claim 11 further comprising the step of:

repeating the steps of the method every time a low water condition is detected.

13. The method of claim 12 further comprising the steps of:

determining if the total amount of water added during the last instance of said method is over a predetermined maximum amount of water; and if said total amount of water added during said last instance is above said predetermined maximum amount of water, inhibiting said step of repeating.

14. The method of claim 13 wherein if said total amount of water is above a predetermined maximum amount, the step of closing is immediately performed.

15. The method of claim 14 further comprising:

triggering an alarm condition if said amount of water added during said last instance is above said predetermined maximum amount of water.

16. The method of claim 12 further comprising the steps of:

determining if the total amount of water added during all instances of said method occurring within a predetermined period of time is over a predetermined maximum amount of water; and if said total amount of water added during all instances of said method occurring within said predetermined period of time is above a predetermined maximum amount of water, not performing said step of repeating.

17. The method of claim 16 further comprising:

triggering an alarm condition is said total amount of water added during all instances of said method occurring within said predetermined period of time is above said predetermined maximum amount.

18. A system for controlling water feed to a boiler, the system comprising:

electronics for monitoring the signal from a low water cut-off (LWCO);

electronics for opening and closing a water path into said boiler; and a processor having a clock source;

wherein when said electronics for monitoring detect a low water signal from said LWCO, said processor initiates opening of said water path to allow water to flow into said boiler;

wherein which said processor determines when said boiler has sufficient water to close said water path to said boiler, said electronics close said water path;

wherein said processor adds the amount of water added between the instance of opening and closing the water path to a value representative of the water added for a sub-period of time determined by said clock source;

wherein at the end of said sub-period of time, said processor writes said value for said sub-period to a memory; and wherein said processor computes the total amount of water added in a period by adding the values for the immediately prior sub-periods forming that period; and wherein if said amount is over a preset limit, triggers an alarm condition.

19. The system of claim 18 wherein said period comprises 30 days.

20. The system of claim 18 wherein said sub-period comprises one day.

21. The system of claim 18 wherein when said alarm condition is triggered, said system will not allow additional water to be added to said boiler during the current sub-period.

* * * * *